US007843421B2

(12) United States Patent
Chang et al.

(10) Patent No.: US 7,843,421 B2
(45) Date of Patent: Nov. 30, 2010

(54) GATE DRIVER AND DRIVING METHOD THEREOF IN LIQUID CRYSTAL DISPLAY

(75) Inventors: Lee-Hsun Chang, Hsin-Chu (TW); Chung-Lung Li, Hsin-Chu (TW); Yu-Wen Lin, Hsin-Chu (TW); Yung-Tse Cheng, Hsin-Chu (TW)

(73) Assignee: Au Optronics Corporation, Hsin-Chu (TW)

( * ) Notice: Subject to any disclaimer, the term of this patent is extended or adjusted under 35 U.S.C. 154(b) by 765 days.

(21) Appl. No.: 11/769,310

(22) Filed: Jun. 27, 2007

(65) Prior Publication Data

US 2008/0174580 A1 Jul. 24, 2008

(30) Foreign Application Priority Data

Oct. 13, 2006 (TW) ..... 95137770

(51) Int. Cl.
*G09G 3/36* (2006.01)

(52) U.S. Cl. ..... 345/100; 345/204; 377/64

(58) Field of Classification Search ..... 345/87, 345/92–100, 204, 209, 211; 377/77.78, 64
See application file for complete search history.

(56) References Cited

U.S. PATENT DOCUMENTS

| | | | | |
|---|---|---|---|---|
| 5,410,583 | A | 4/1995 | Weisbrod et al. | |
| 5,434,899 | A | 7/1995 | Huq et al. | |
| 5,859,630 | A | 1/1999 | Huq | |
| 6,845,140 | B2 | 1/2005 | Moon et al. | |
| 6,876,353 | B2 * | 4/2005 | Morosawa et al. | 345/100 |
| 2003/0043104 | A1 * | 3/2003 | Lee et al. | 345/92 |
| 2003/0189542 | A1 | 10/2003 | Lee et al. | |
| 2004/0046729 | A1 | 3/2004 | Moon | |
| 2005/0001805 | A1 | 1/2005 | Jeon et al. | |
| 2006/0061535 | A1 * | 3/2006 | Kim et al. | 345/98 |

* cited by examiner

*Primary Examiner*—Amare Mengistu
*Assistant Examiner*—Hong Zhou
(74) *Attorney, Agent, or Firm*—Thomas, Kayden, Horstemeyer & Risley, LLP

(57) ABSTRACT

A gate driver includes several first and second circuit units outputting first and second driving signals to odd and even gate lines, respectively, and each of the first circuit units or the second circuit units includes a signal output unit for outputting the driving signal and a shift register unit for outputting a start signal to a next circuit unit. A driving method is also disclosed.

22 Claims, 7 Drawing Sheets

GATE DRIVER AND DRIVING METHOD THEREOF IN LIQUID CRYSTAL DISPLAY

RELATED APPLICATIONS

This application claims priority to Taiwan Patent Application Serial Number 95137770, filed Oct. 13, 2006, which is herein incorporated by reference.

BACKGROUND

1. Field of Invention

The present invention relates to a gate driver and a driving method thereof. More particularly, the present invention relates to a gate driver and a driving method thereof for use in a liquid crystal display.

2. Description of Related Art

In recent years, technology has continued to develop significantly and different types of electronic products available change day by day. Among the various electronic products, liquid crystal displays have many advantages such as thin volume, low power consumption, and compatible with current semiconductor fabrication process. So liquid crystal displays have gradually become the mainstream among various candidates of flat panel displays. In addition, because the cost of the driving integrated circuit for use in the liquid crystal display is high, using fewer driving integrated circuits without affecting the performance of the liquid crystal display can reduce the manufacturing cost.

In a conventional liquid crystal display, each data line or gate line has to couple to different driving integrated circuits, so that the data can be inputted, or each pixel can be informed while inputting the data. By using the approach, many driving integrated circuits have to be used while inputting the data into the pixel regions, and the production cost is therefore very high.

FIG. 1A is a clock diagram of the driving signal in the prior art. FIG. 1B is a diagram showing the pixel regions formed with the gate lines and the data lines in the prior art. For example, the driving signals outputted from the gate driving integrated circuits are designed as shown in FIG. 1A and used for the pixel regions as shown in FIG. 1B. Taking the driving signal which is transmitted by the scan line $G_n$ for example, the driving signal during the time period $T_3$ is at a high level and the transistor M1 and M2 are turned on, so the data signal carried by the data line $D_n$ is transmitted to the pixel 100 through the transistor M1 for charging. The driving signal during the time period $T_4$ is at a low level, so the transistor M1 and M2 are turned off. Then, the driving signal during the time period $T_5$ is at a high level and the transistor M1 and M2 are turned on again, and the driving signal of the scan line $G_{n+1}$ is also at a high level, so the transistor M3 is turned on as well. At this moment, the data signal carried by the data line $D_n$ is transmitted to the pixel 110 through the transistor M3 and then transmitted to the pixel 120 through the transistor M2 to complete charging. The driving signal of the scan line $G_n$ is at a high level again during the time period $T_6$ so that the transistor M1 is turned on again, and the data signal is thus transmitted to the pixel 100 through the transistor M1 for charging again and replacing the data of the pixel 100 during the time period $T_3$. Therefore, the data driving integrated circuits required to connect the data lines can be saved, and the display can be functioned as usual. However, this kind of skill can only be used to save the data driving integrated circuits, but does not solve the problem of using many gate driving integrated circuits.

For the foregoing reasons, there is a need to provide a gate driver that is able to save the usage of the gate driving integrated circuits and reduce the production cost.

SUMMARY

It is therefore an object of the present invention to provide a gate driver and a driving method thereof in a liquid crystal display to reduce the gate driving integrated circuits and output the driving signals capable of saving the data driving integrated circuits, so as to reduce the production cost.

According to the foregoing object, a gate driver is provided. In accordance with one embodiment of the present invention, the gate driver is capable of driving a plurality of gate lines in a liquid crystal display, and includes a plurality of first circuit units which are electrically cascade-connected and a plurality of second circuit units which are electrically cascade-connected. The first circuit units output a plurality of first driving signals to the odd gate lines, and the second circuit units output a plurality of second driving signals to the even gate lines. Each of the first circuit units includes a first signal output unit and a first shift register unit. The first signal output unit receives a first start signal and a first input signal to generate the first driving signal. The first shift register unit receives the first start signal and a first clock signal to generate a next first start signal, and transmits the next first start signal to a next first circuit unit of the first circuit units. Each of the second circuit units also includes a second signal output unit and a second shift register unit. The second signal output unit receives a second start signal and a second input signal to generate the second driving signal. The second shift register unit receives the second start signal and a second clock signal to generate a next second start signal, and transmits the next second start signal to a next second circuit unit of the second circuit units.

In addition, a driving method is provided to drive the liquid crystal display having the foregoing gate driver. The driving method includes providing a first start signal and a first input signal to the first signal output unit to generate a first driving signal, and providing a second start signal and a second input signal to the second signal output unit to generate a second driving signal. Also, the driving method includes transmitting the first start signal and a first clock signal to the first shift register unit to generate a next first start signal and transmitting the next first start signal to the next first circuit unit, and transmitting the second start signal and a second clock signal to the second shift register unit to generate a next second start signal and transmitting the next second start signal to the next second circuit unit.

So, the gate driving integrated circuits can be reduced, and the data driving integrated circuits can be saved as well to reduce the production cost.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the preferred embodiment, with reference made to the accompanying drawings as follows.

DESCRIPTION OF THE PREFERRED EMBODIMENTS

Detailed illustrative embodiments of the present invention are disclosed herein. However, specific details disclosed herein are merely representative for purposes of describing exemplary embodiments of the present invention. This invention may, however, be embodied in many alternate forms and should not be construed as limited to the embodiments set forth herein.

The present invention is directed to a gate driver and a driving method thereof for use in a liquid crystal display, which are capable of saving the gate driving integrated circuits and outputting the driving signals capable of saving the data driving integrated circuits, so as to reduce the production cost.

Figure 1A:
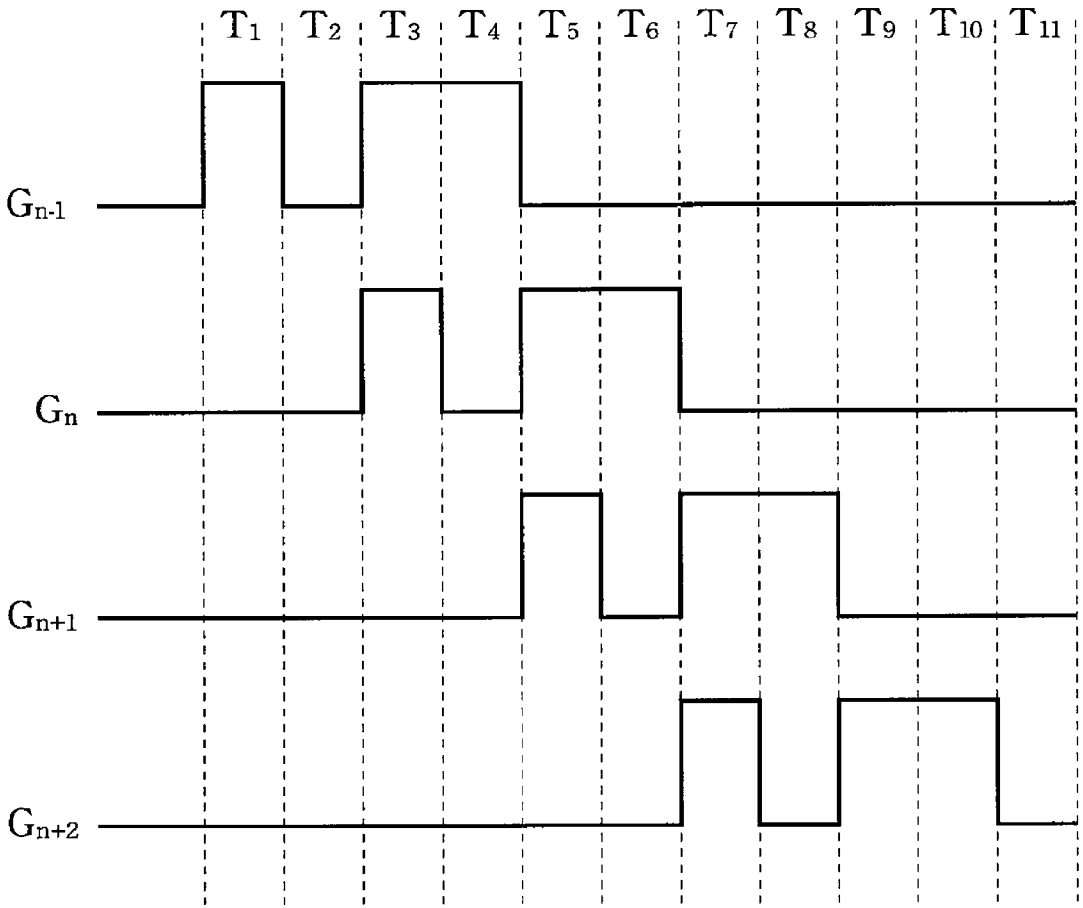
Fig. 1A (PRIOR ART)
FIG. 1A is a timing diagram of the driving signal in the prior art.
Figure 1B:
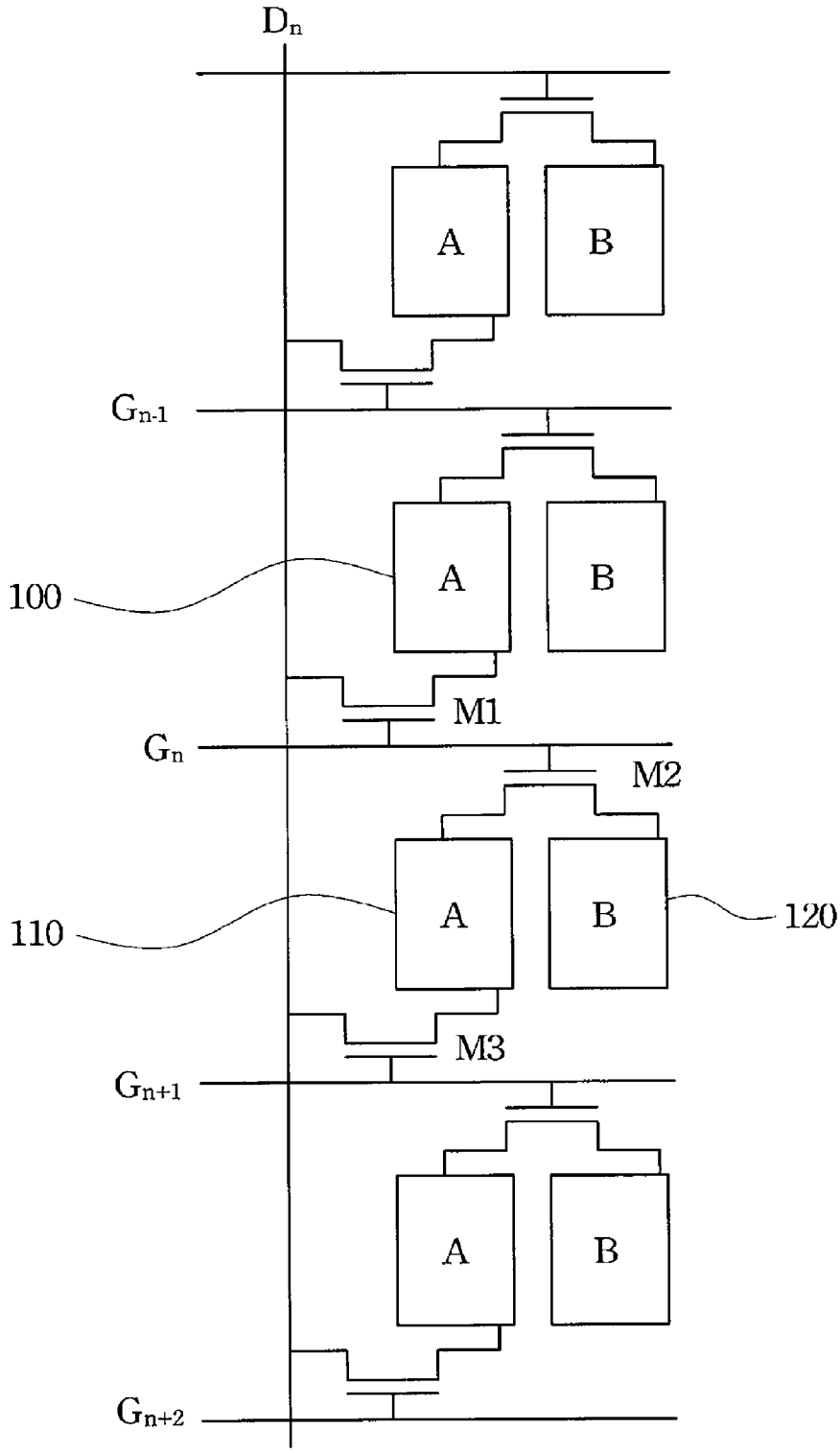
Fig. 1B (PRIOR ART)
FIG. 1B is a diagram showing the pixel regions formed with the gate lines and the data lines in the prior art.
Figure 2:
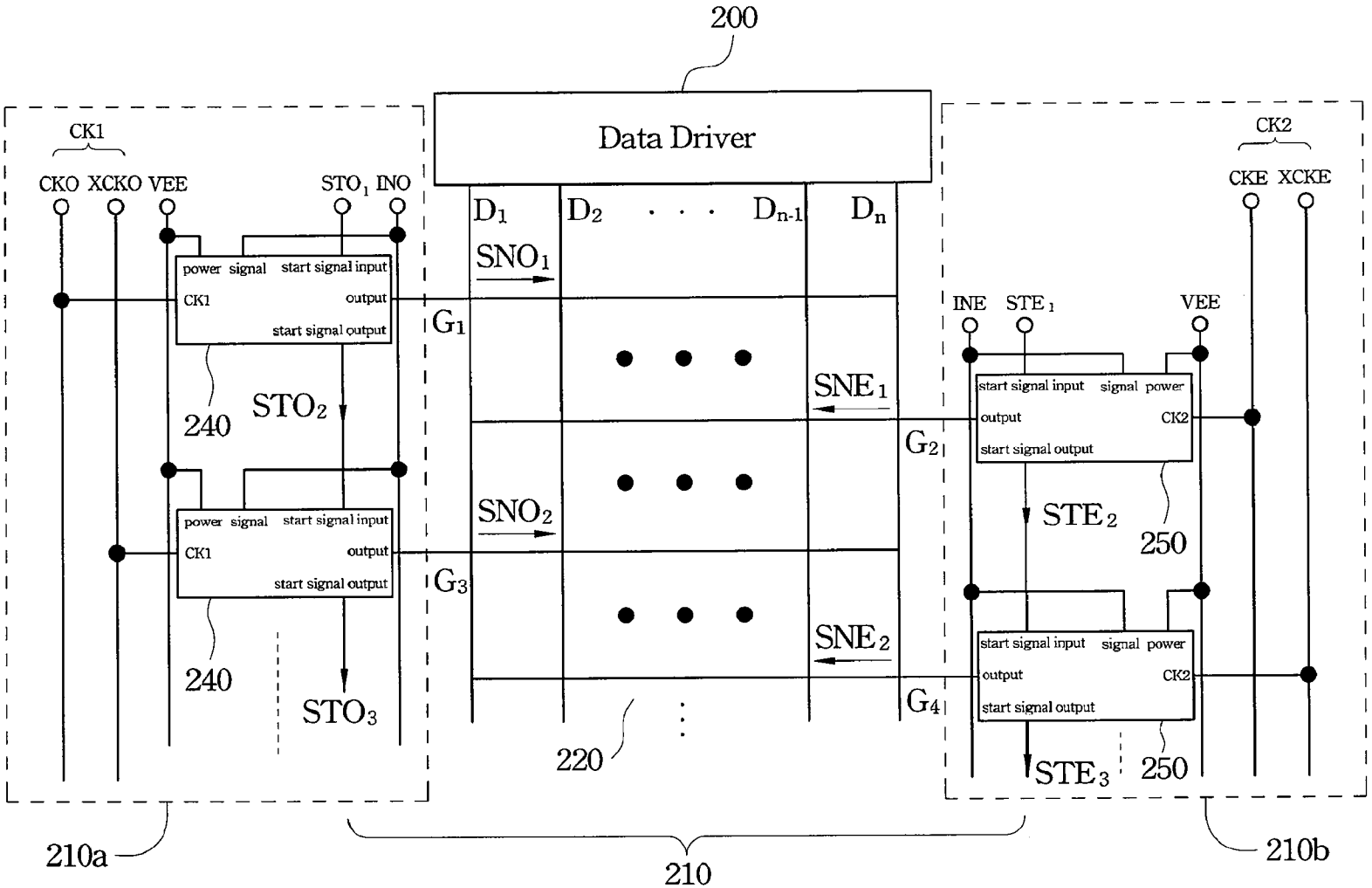
FIG. 2 is a diagram showing a liquid crystal display panel according to one embodiment of the present invention.

FIG. 2 is a diagram showing a liquid crystal display panel according to one embodiment of the present invention. The liquid crystal display panel includes a plurality of data lines $D_1 \ldots D_n$, a plurality of gate lines $G_1 \ldots G_n$, a data driver 200 and a gate driver 210. The gate driver 210 is used to drive the gate lines $G_1 \ldots G_n$ of the liquid crystal display, and is divided into a first gate driver 210*a* and a second gate driver 210*b*, wherein the first gate driver 210*a* has a plurality of first circuit units 240 which are electrically cascade-connected and the second gate driver 210*b* has a plurality of second circuit units 250 which are electrically cascade-connected. In addition, the data driver 200 couples to the data lines $D_1 \ldots D_n$ and transmits a plurality of image signals to the data lines $D_1 \ldots D_n$. The first circuit units 240 of the gate driver 210 respectively couple to the odd gate lines $G_1 \ldots G_{2n-1}$ and transmit a plurality of first driving signals $SNO_1 \ldots SNO_N$ to the odd gate lines $G_1 \ldots G_{2n-1}$. The second circuit units 250 of the gate driver 210 respectively couple to the even gate lines $G_2 \ldots G_{2n-2}$ and transmit a plurality of second driving signals $SNE_1 \ldots SNE_N$ to the even gate lines $G_2 \ldots G_{2n-2}$. The data lines $D_1 \ldots D_n$ and the gate lines $G_1 \ldots G_n$ are mutually crossed to form a display cell array 220, and the display cell array 220 displays images according to the image signals transmitted by the data lines $D_1 \ldots D_n$ and the driving signals transmitted by the gate lines $G_1 \ldots G_n$.

Each of the first circuit units 240 is identical. Taking an N-th first circuit unit 240 for example, the N-th first circuit unit 240 has a power terminal for coupling to a power voltage VEE, a signal terminal for receiving a first input signal INO, an output terminal for outputting the N-th first driving signal $SNO_N$ and a start signal input terminal for receiving the first start signal $STO_N$ outputted from the (N−1)-th first circuit unit 240, and outputs the first start signal $STO_{N+1}$ from a start signal output terminal to the start signal input terminal of the (N+1)-th first circuit unit 240. Further, each of the first circuit units 240 has a clock terminal for receiving a first clock signal CK1, wherein the first clock signal CK1 is divided into a first positive phase clock signal CKO and a first opposite phase clock signal XCKO, wherein one of every two adjacent first circuit units 240 receives the first positive phase clock signal CKO and the other one of every two adjacent first circuit units 240 receives the first opposite phase clock signal XCKO. According to one embodiment, the (N+1)-th first circuit unit 240 receives the first opposite phase clock signal XCKO while the N-th first circuit unit 240 receives the first positive phase clock signal CKO.

Each of the second circuit units 250 is identical as well. Taking an N-th second circuit unit 250 for example, the N-th second circuit unit 250 has a power terminal for coupling to a power voltage VEE, a signal terminal for receiving a second input signal INE, an output terminal for outputting the N-th second driving signal $SNE_N$ and a start signal input terminal for receiving the second start signal $STE_N$ outputted from the (N−1)-th second circuit unit 250, and outputs the second start signal $STE_{N+1}$ from a start signal output terminal to the start signal input terminal of the (N+1)-th second circuit unit 250. Further, each of the second circuit units 250 has a clock terminal for receiving a second clock signal CK2, wherein the second clock signal CK2 is divided into a second positive phase clock signal CKE and a second opposite phase clock signal XCKE, wherein one of every two adjacent second circuit units 250 receives the second positive phase clock signal CKE and the other one of every two adjacent second circuit units 250 receives the second opposite phase clock signal XCKE. According to one embodiment, the (N+1)-th second circuit unit 250 receives the second opposite phase clock signal XCKE while the N-th second circuit unit 250 receives the second positive phase clock signal CKE.

Figure 5:
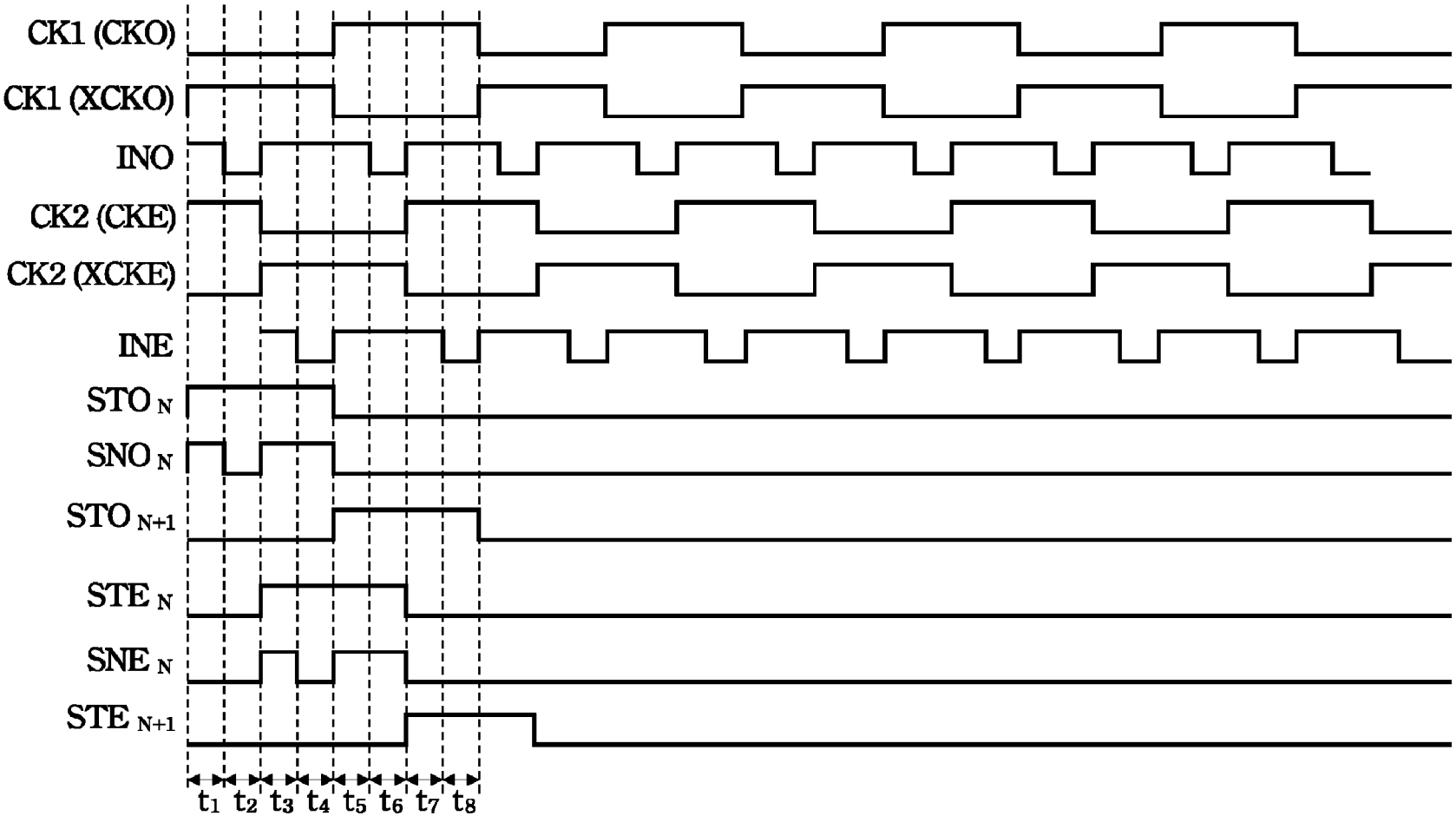
FIG. 5 is a timing diagram showing the operations of the circuit units according to one embodiment of the present invention.

FIG. 5 is a clock diagram showing the operations of the circuit units according to one embodiment of the present invention. The first input signal INO and the second input signal INE are of the same wave form, and the second input signal INE lags half a period (t1+t2) behind the first input signal INO. The N-th first start signal $STO_N$ and the N-th second start signal $STE_N$ are of the same waveform and separated from the predetermined time interval (t1+t2). Besides, the first clock signal CK1 and the second clock signal CK2 are of the same waveform and separated from the predetermined time interval. For the first clock signal CK1, the phase of the first positive phase clock signal CKO is opposite to the phase of the first opposite phase clock signal XCKO. For the second clock signal CK2, the phase of the second positive phase clock signal CKE is opposite to the phase of the second opposite phase clock signal XCKE as well. The clock signal CKO and the clock signal CKE (or the clock signal XCKE) are separated from the predetermined time interval (t1+t2), and the clock signal XCKO and the clock signal CKE (or the clock signal XCKE) are separated from the predetermined time interval (t1+t2) as well.

Figure 3:
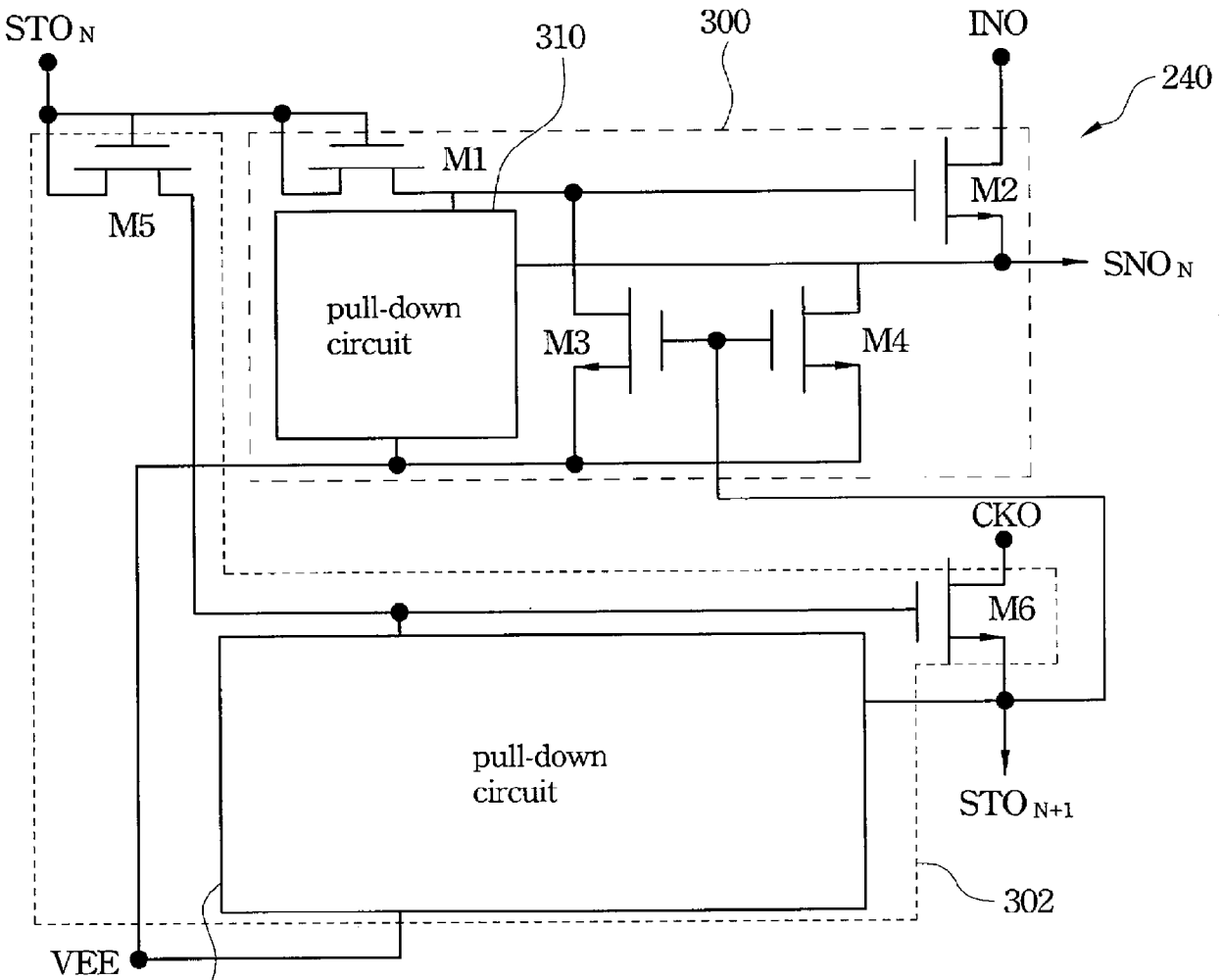
FIG. 3 is a diagram showing the structure of the first circuit unit according to one embodiment of the present invention.

FIG. 3 is a diagram showing the structure of the first circuit unit according to one embodiment of the present invention. Taking the N-th first circuit unit 240 for example, the present N-th first circuit unit 240 includes a first signal output unit 300 and a first shift register unit 302. The first signal output unit 300 receives the first input signal INO and the first start signal $STO_N$ outputted from the (N−1)-th first circuit unit 240 to generate the present N-th first driving signal $SNO_N$. In addition, taking this embodiment for example, the present N-th first shift register unit 302 receives the first positive phase clock signal CKO and the first start signal $STO_N$ outputted from the (N−1)-th first circuit unit 240 to generate the first start signal $STO_{N+1}$ of the present N-th stage to be transmitted to the start signal input terminal of the (N+1)-th first circuit unit 240.

The first signal output unit 300 includes a transistor M1, a transistor M2, a transistor M3, a transistor M4, and a pull-down circuit 310. The gate electrode and the first source/drain electrode of the transistor M1 receive the first start signal $STO_N$ transmitted from the (N−1)-th first circuit unit 240. The first source/drain electrode of the transistor M2 receives the first input signal INO, and the second source/drain electrode of the transistor M2 outputs the present N-th first driving signal $SNO_N$. Besides, the first shift register unit 302 includes a transistor M5, a transistor M6, and another pull-down circuit 320. The gate electrode and the first source/drain electrode of the transistor M5 receive the first start signal $STO_N$ transmitted from the (N−1)-th first circuit unit 240. The first source/drain electrode of the transistor M6, taking this embodiment for example, receives the first positive phase clock signal CKO, and the first source/drain electrode of the transistor M6 of the (N+1)-th stage receives the first opposite phase clock signal XCKO. Moreover, the second source/drain electrode of the transistor M6 outputs the first start signal $STO_{N+1}$ of the present N-th stage to be transmitted to the start signal input terminal of the (N+1)-th first circuit unit 240.

Further, in the first signal output unit 300, the second source/drain electrode of the transistor M1, the gate electrode of the transistor M2 and the first source/drain electrode of the transistor M3 are coupled with one another, and the first source/drain electrode of the transistor M4 couples to the second source/drain electrode of the transistor M2, so as to stabilize the first driving signal $SNO_N$. The second source/drain electrodes of the transistor M3 and the transistor M4 couples to the power voltage VEE, and the gate electrodes of the transistor M3 and the transistor M4 receive the signal $STO_{N+1}$ outputted from the first shift register unit 302 as well, so as to stabilize the potential of the gate electrode and the second source/drain electrode of the transistor M2. The pull-down circuit 310 couples to the power voltage VEE and the gate electrode and the second source/drain electrode of the transistor M2 so as to stabilize the first driving signal $SNO_N$. In addition, the second source/drain electrode of the transistor M5 couples to the gate electrode of the transistor M6 in the first shift register unit 302. The other pull-down circuit 320 couples to the power voltage VEE and the gate electrode and the second source/drain electrode of the transistor M6 so as to stabilize the first start signal $STO_{N+1}$ transmitted to the next stage.

The operation in the first circuit unit 240 is described as follows. As shown in FIG. 3 and FIG. 5, during the time period t1, the first start signal $STO_N$ transmitted from the (N−1)-th first circuit unit 240 is at a high level, so the transistors M1 and M5 receive the signal $STO_N$ to be turned on. At the moment, the transistor M2 receives the first input signal INO and receives the signal from the transistor M1 to be turned on, so that outputting the first input signal INO to be the present N-th first driving signal $SNO_N$. Here, a period of the signal INO is divided into four durations t1, t2, t3, and t4, and the signal is at a high level during the time period t1, t3, and t4, and the signal is at a low level during the time period t2. Besides, a capacitor (not shown) exists between the gate electrode and the first source/drain electrode of the transistor M6, for temporarily storing the signal from the transistor M5. As the time period t5 begins, the first positive phase clock signal CKO changes from low level to high level. The transistor M6 receives the signal CKO, and is turned on because of the signal, from the transistor M5, stored in the capacitor to output the signal CKO to be the first start signal $STO_{N+1}$ transmitted to the (N+1)-th first circuit unit 240. Moreover, the signal $STO_{N+1}$ is also transmitted to the gate electrodes of the transistors M3 and M4 of the present N-th stage, so that the transistors M3 and M4 are turned on, and the potential of the gate electrode and the second source/drain electrode of the transistor M2 are therefore pulled down to the power voltage VEE so as to stabilize the circuit to avoid the errors of the circuit.

Figure 4:
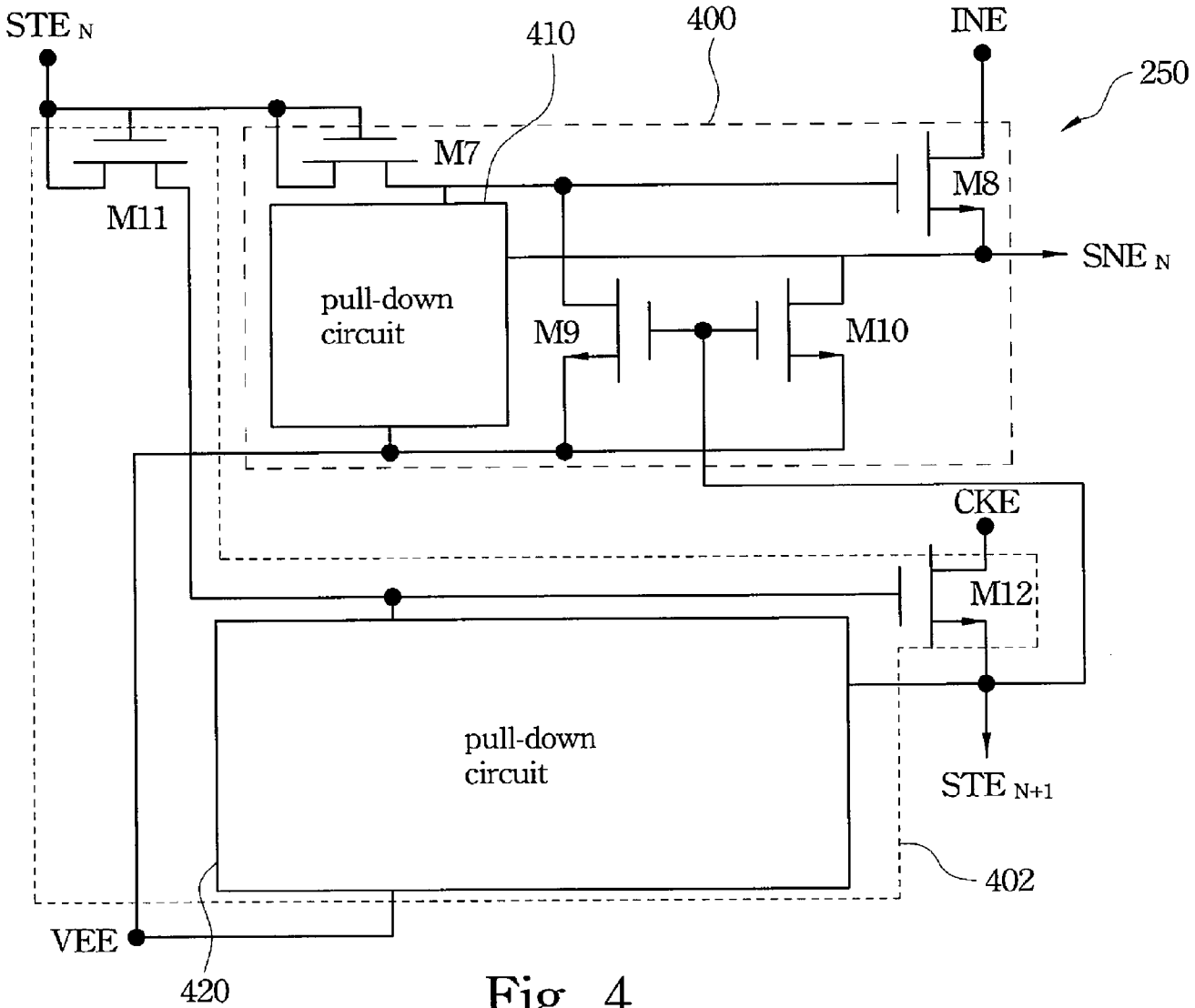
FIG. 4 is a diagram showing the structure of the second circuit unit according to one embodiment of the present invention.

On the other hand, the second circuit unit 250 and the first circuit unit 250 have similar structures. FIG. 4 is a diagram showing the structure of the second circuit unit according to one embodiment of the present invention. Taking the N-th second circuit unit 250 for example, the present N-th second circuit unit 250 includes a second signal output unit 400 and a second shift register unit 402. The second signal output unit 400 receives the second input signal INE and the second start signal $STE_N$ outputted from the (N−1)-th second circuit unit 250 to generate the present N-th second driving signal $SNE_N$. In addition, taking this embodiment for example, the N-th second shift register unit 402 receives the second positive phase clock signal CKE and the second start signal $STE_N$ outputted from the (N−1)-th second circuit unit 250 to generate the second start signal $STE_{N+1}$ of the present N-th stage to be transmitted to the start signal input terminal of the (N+1)-th second circuit unit 250.

The second signal output unit 400 includes a transistor M7, a transistor M8, a transistor M9, a transistor M10, and a pull-down circuit 410. The gate electrode and the first source/drain electrode of the transistor M7 receive the second start signal $STE_N$ transmitted from the (N−1)-th second circuit unit 250. The first source/drain electrode of the transistor M8 receives the second input signal INE, and the second source/drain electrode of the transistor M8 outputs the present N-th second driving signal $SNE_N$. Besides, the second shift register unit 402 includes a transistor M11, a transistor M12, and another pull-down circuit 420. The gate electrode and the first source/drain electrode of the transistor M11 receive the second start signal $STE_N$ transmitted from the (N−1)-th second circuit unit 250. The first source/drain electrode of the transistor M12, taking this embodiment for example, receives the second positive phase clock signal CKE, and the first source/drain electrode of the transistor M12 of the (N+1)-th stage receives the second opposite phase clock signal XCKE. Moreover, the second source/drain electrode of the transistor M12 outputs the second start signal $STE_{N+1}$ of the present N-th stage to be transmitted to the start signal input terminal of the (N+1)-th second circuit unit 250.

Further, in the second signal output unit 400, the second source/drain electrode of the transistor M7, the gate electrode of the transistor M8 and the first source/drain electrode of the transistor M9 are coupled with one another, and the first source/drain electrode of the transistor M10 couples to the second source/drain electrode of the transistor M8, so as to stabilize the second driving signal $SNE_N$. The second source/drain electrodes of the transistor M9 and the transistor M10 couples to the power voltage VEE, and the gate electrodes of the transistor M9 and the transistor M10 receive the signal $STE_{N+1}$ outputted from the second shift register unit 402 as well, so as to stabilize the potential of the gate electrode and the second source/drain electrode of the transistor M8. The pull-down circuit 410 couples to the power voltage VEE and the gate electrode and the second source/drain electrode of the transistor M8 so as to stabilize the second driving signal $SNE_N$. In addition, the second source/drain electrode of the transistor M11 couples to the gate electrode of the transistor M12 in the second shift register unit 402. The other pull-down circuit 420 couples to the power voltage VEE and the gate electrode and the second source/drain electrode of the transistor M12 so as to stabilize the second start signal $STE_{N+1}$ transmitted to the next stage.

The operation in the second circuit unit 250 is described as follows. As shown in FIG. 4 and FIG. 5, during the time period t3, the second start signal $STE_N$ transmitted from the (N−1)-th second circuit unit 250 is at a high level, so the transistors M7 and M11 receive the signal $STE_N$ to be turned on. At the moment, the transistor M8 receives the second input signal INE and receives the signal from the transistor M7 to be turned on, so that outputting the second input signal INE to be the present N-th second driving signal $SNE_N$. Here, a period of the signal INE is divided into four durations t3, t4, t5, and t6, and the signal is at a high level during the time period t3, t5, and t6, and the signal is at a low level during the time period t4. Besides, a capacitor (not shown) exists between the gate electrode and the first source/drain electrode of the transistor M12, for temporarily storing the signal from the transistor M11. As the time period t7 begins, the second positive phase clock signal CKE changes from low level to high level. The transistor M12 receives the signal CKE, and is turned on because of the signal, from the transistor M11, stored in the capacitor to output the signal CKE to be the second start signal $STE_{N+1}$ transmitted to the (N+1)-th second circuit unit 250. Moreover, the signal $STE_{N+1}$ is also transmitted to the gate electrodes of the transistors M9 and M10 of the present N-th stage, so that the transistors M9 and M10 are turned on, and the potential of the gate electrode and the second source/drain electrode of the transistor M8 are therefore pulled down to the power voltage VEE so as to stabilize the circuit to avoid the errors of the circuit.

Figure 6:
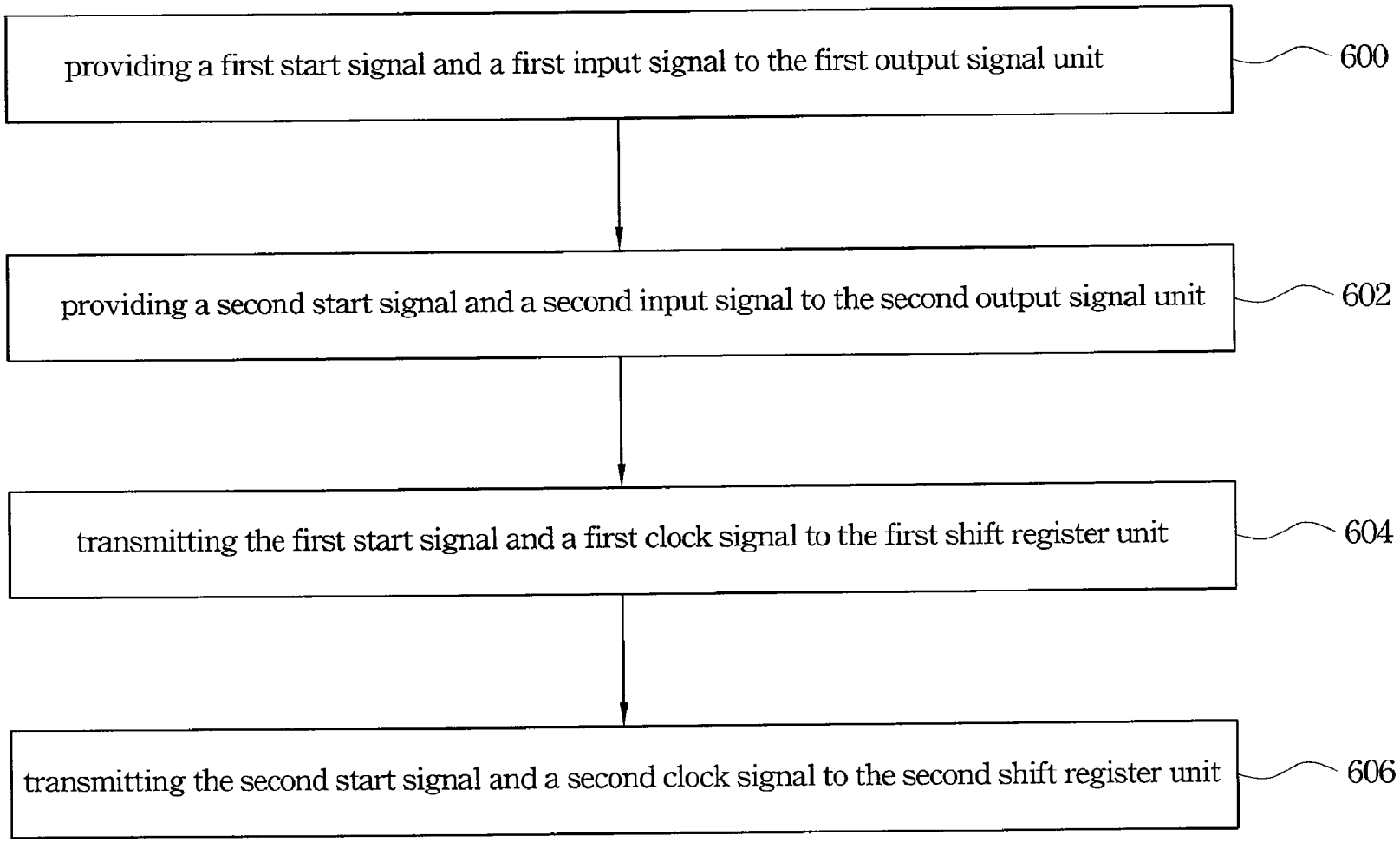
FIG. 6 is a flow chart of the method for driving the liquid crystal display panel shown in FIG. 2 according to one embodiment of the present invention.

Furthermore, a driving method is provided to drive a liquid crystal display having the foregoing circuit structures. FIG. 6 is a flow chart of the method for driving the liquid crystal display panel shown in FIG. 2 according to one embodiment of the present invention. As shown in FIG. 3, FIG. 4, and FIG. 6, and take the N-th first circuit unit and the N-th second circuit unit for example. In step 600 of FIG. 6, a first input signal INO and a first start signal $STO_N$ outputted from the (N−1)-th stage are provided to the first signal output unit 300 as shown in FIG. 3 to generate a first driving signal $SNO_N$ of the N-th stage. Then, in step 602, a second input signal INE and a second start signal $STE_N$ outputted from the (N−1)-th stage are provided to the second signal output unit 400 as shown in FIG. 4 to generate a second driving signal $SNE_N$ of the N-th stage. In step 604, a first clock signal CK1 and the first start signal $STO_N$ outputted from the (N−1)-th stage are transmitted to the first shift register unit 302 as shown in FIG. 3 to generate the (N+1)-th first start signal $STO_{N+1}$, and the (N+1)-th first start signal $STO_{N+1}$ is transmitted to the (N+1)-th first circuit unit 240. Then, in step 606, a second clock signal CK2 and the second start signal $STE_N$ outputted from the (N−1)-th stage are transmitted to the second shift register unit 402 as shown in FIG. 4 to generate the (N+1)-th second start signal $STE_{N+1}$, and the (N+1)-th second start signal $STE_{N+1}$ is transmitted to the (N+1)-th second circuit unit 250. Accordingly, the driving signals are outputted from the first circuit units and the second circuit units, respectively, to the gate lines.

On the other hand, the first input signal INO and the second input signal INE are of the same wave form, and the second input signal INE lags half a period behind the first input signal INO. Besides, the first clock signal CK1 and the second clock signal CK2 are of the same waveform and separated from a predetermined time interval, wherein the first clock signal CK1 is divided into a first positive phase clock signal CKO and a first opposite phase clock signal XCKO, and the second clock signal CK2 is divided into a second positive phase clock signal CKE and a second opposite phase clock signal XCKE. For the first clock signal CK1, the phase of the first positive phase clock signal CKO is opposite to the phase of the first opposite phase clock signal XCKO. For the second clock signal CK2, the phase of the second positive phase clock signal CKE is opposite to the phase of the second opposite phase clock signal XCKE. The clock signal CKO and the clock signal CKE (or the clock signal XCKE) are separated from the predetermined time interval (t1+t2), and the clock signal XCKO and the clock signal CKE (or the clock signal XCKE) are separated from the predetermined time interval (t1+t2) as well. Further, the N-th first start signal $STO_N$ and the N-th second start signal $STE_N$ are of the same waveform and separated from a predetermined time interval.

As is understood by a person skilled in the art, the foregoing preferred embodiments of the present invention are illustrated of the present invention rather than limiting of the present invention. It is intended to cover various modifications and similar arrangements included within the spirit and scope of the appended claims, the scope of which should be accorded the broadest interpretation so as to encompass all such modifications and similar structures.

What is claimed is:

1. A gate driver for driving a plurality of gate lines in a liquid crystal display, the gate driver comprising:

a first circuit unit for outputting a first driving signal to one odd gate line of the gate lines, comprising:

a first signal output unit for receiving a first odd start signal and a first input signal to generate the first driving signal corresponding to the first input signal; and a first shift register unit for receiving the first odd start signal and a first clock signal to generate a second odd start signal, the first clock signal being different from the first input signal;

a second circuit unit for outputting a second driving signal to another odd gate line of the gate lines, the second circuit unit electrically coupling to the first circuit unit and comprising:

a second signal output unit for receiving the second odd start signal and the first input signal to generate the second driving signal corresponding to the first input signal; and a second shift register unit for receiving the second odd start signal and the first clock signal to generate a third odd start signal;

a third circuit unit for outputting a third driving signal to one even gate line of the gate lines, comprising:

a third signal output unit for receiving a first even start signal and a second input signal to generate the third driving signal corresponding to the second input signal; and a third shift register unit for receiving the first even start signal and a second clock signal to generate a second even start signal, the second clock signal being different from the second input signal; and a fourth circuit unit for outputting a fourth driving signal to another even gate line of the gate lines, the fourth circuit unit electrically coupling to the third circuit unit and comprising:

a fourth signal output unit for receiving the second even start signal and the second input signal to generate the fourth driving signal corresponding to the second input signal; and a fourth shift register unit for receiving the second even start signal and the second clock signal to generate a third even start signal.

2. The gate driver of claim 1, wherein the first clock signal comprises a first positive phase clock signal and a first opposite phase clock signal, and wherein the phase of the first positive phase clock signal is opposite to the phase of the first opposite phase clock signal.

3. The gate driver of claim 2, wherein the first circuit unit is configured to receive the first positive phase clock signal, and the second circuit unit is configured to receive the first opposite phase clock signal.

4. The gate driver of claim 1, wherein the second clock signal comprises a second positive phase clock signal and a second opposite phase clock signal, and wherein the phase of the second positive phase clock signal is opposite to the phase of the second opposite phase clock signal.

5. The gate driver of claim 4, wherein the third circuit unit is configured to receive the second positive phase clock signal, and the fourth circuit unit is configured to receive the second opposite phase clock signal.

6. The gate driver of claim 1, wherein the first clock signal and the second clock signal are of the same waveform and separated from a predetermined time interval.

7. The gate driver of claim 1, wherein the first odd start signal and the first even start signal are of the same waveform and separated from a predetermined time interval.

8. The gate driver of claim 1, wherein the first input signal and the second input signal are of the same wave form, and the second input signal lags half a period behind the first input signal.

9. The gate driver of claim 8, wherein the period of the first input signal is divided into four durations, the first input signal is at a high level in the first, third, and fourth durations, and the first input signal is at a low level in the second duration.

10. The gate driver of claim 1, wherein the first signal output unit comprises:

a first transistor, the gate electrode and the first source/drain electrode of the first transistor receiving the first odd start signal;

a second transistor, the first source/drain electrode of the second transistor receiving the first input signal, the second source/drain electrode of the second transistor outputting the first driving signal;

a third transistor, the gate electrode of the third transistor receiving the second odd start signal, the second source/drain electrode of the third transistor coupling to a power voltage ; and a fourth transistor, the gate electrode of the fourth transistor receiving the second odd start signal, the second source/drain electrode of the fourth transistor coupling to the power voltage;

wherein the first source/drain electrode of the third transistor, the second source/drain electrode of the first transistor and the gate electrode of the second transistor are coupled with one another, and the first source/drain electrode of the fourth transistor couples to the second source/drain electrode of the second transistor, so as to stabilize the first driving signal.

11. The gate driver of claim 10, wherein the first signal output unit further comprises a first pull-down circuit, and the first pull-down circuit couples to the gate electrode and the second source/drain electrode of the second transistor and the power voltage so as to stabilize the first driving signal.

12. The gate driver of claim 1, wherein the first shift register unit comprises:

a first transistor, the gate electrode and the first source/drain electrode of the first transistor receiving the first odd start signal; and a second transistor, the first source/drain electrode of the second transistor receiving the first clock signal, the second source/drain electrode of the second transistor outputting the second odd start signal, the gate electrode of the second transistor coupling to the second source/drain electrode of the first transistor, so as to output the second odd start signal according to the first odd start signal and the first clock signal.

13. The gate driver of claim 12, wherein the first shift register unit further comprises a second pull-down circuit, and the second pull-down circuit couples to the gate electrode and the second source/drain electrode of the second transistor and the power voltage, so as to stabilize the second odd start signal.

14. The gate driver of claim 1, wherein the third signal output unit comprises:

a first transistor, the gate electrode and the first source/drain electrode of the first transistor receiving the first even start signal;

a second transistor, the first source/drain electrode of the second transistor receiving the second input signal, the second source/drain electrode of the second transistor outputting the third driving signal;

a third transistor, the gate electrode of the third transistor receiving the second even start signal, the second source/drain electrode of the third transistor coupling to a power voltage ; and a fourth transistor, the gate electrode of the fourth transistor receiving the second even start signal, the second source/drain electrode of the fourth transistor coupling to the power voltage ;

wherein the first source/drain electrode of the third transistor, the second source/drain electrode of the first transistor and the gate electrode of the second transistor are coupled with one another, and the first source/drain electrode of the fourth transistor couples to the second source/drain electrode of the second transistor, so as to stabilize the third driving signal.

15. The gate driver of claim 14, wherein the second signal output unit further comprises a third pull-down circuit, and the third pull-down circuit couples to the gate electrode and the second source/drain electrode of the second transistor and the power voltage so as to stabilize the third driving signal.

16. The gate driver of claim 1, wherein the second shift register unit comprises:

a first transistor, the gate electrode and the first source/drain electrode of the first transistor receiving the first even start signal; and a second transistor, the first source/drain electrode of the second transistor receiving the second clock signal, the second source/drain electrode of the second transistor outputting the second even start signal, the gate electrode of the second transistor coupling to the second source/drain electrode of the first transistor, so as to output the second even start signal according to the first even start signal and the second clock signal.

17. The gate driver of claim 16, wherein the second shift register unit further comprises a fourth pull-down circuit, and the fourth pull-down circuit couples to the gate electrode and the second source/drain electrode of the second transistor and the power voltage, so as to stabilize the second even start signal.

18. A liquid crystal display, comprising:

a plurality of data lines;

a plurality of gate lines crossing the data lines to form a display cell array;

a data driver coupled to the data lines and generating a plurality of image signals to the data lines; and a gate driver coupled to the gate lines and generating a plurality of driving signals to the gate lines, the gate driver comprising:

a plurality of first circuit units, which are electrically cascade-connected, coupled to odd gate lines of the gate lines and outputting a plurality of first driving signals to the odd gate lines, wherein each of the first circuit units comprises a first signal output unit and a first shift register unit, and the first signal output unit receives a first input signal and a first start signal to generate the first driving signal corresponding to the first input signal, and the first shift register unit receives the first start signal and a first clock signal different from the first input signal, to generate a next first start signal for a next first circuit unit of the first circuit units and transmits the next first start signal to the next first circuit unit; and a plurality of second circuit units, which are electrically cascade-connected, coupled to even gate lines of the gate lines and outputting a plurality of second driving signals to the even gate lines, wherein each of the second circuit units comprises a second signal output unit and a second shift register unit, and the second signal output unit receives a second input signal and a second start signal to generate the second driving signal corresponding to the second input signal, and the second shift register unit receives the second start signal and a second clock signal different from the second input signal, to generate a next second start signal for a next second circuit unit of the second circuit units and transmits the next second start signal to the next second circuit unit.

19. A method for driving the liquid crystal display of claim 18, comprising:

providing a first start signal and a first input signal to the first signal output unit to generate a first driving signal, and providing a second start signal and a second input signal to the second signal output unit to generate a second driving signal; and transmitting the first start signal and a first clock signal to the first shift register unit to generate a next first start signal for the next first circuit unit and transmitting the next first start signal to the next first circuit unit, and transmitting the second start signal and a second clock signal to the second shift register unit to generate a next second start signal for the next second circuit unit and transmitting the next second start signal to the next second circuit unit.

20. The method of claim 19, wherein the first and second clock signals are of the same waveform and separated from a predetermined time interval.

21. The method of claim 19, wherein the first and second start signals are of the same waveform and separated from a predetermined time interval.

22. The method of claim 19, wherein the first and second input signals are of the same wave form, and the second input signal lags half a period behind the first input signal.

* * * * *